US006381865B1

(12) United States Patent
Noesthedent

(10) Patent No.: US 6,381,865 B1
(45) Date of Patent: May 7, 2002

(54) SPIN DRYER FOR INDUSTRIAL PARTS

(75) Inventor: Andrew Noesthedent, Tecumseh (CA)

(73) Assignee: Valiant Corporation (CA)

( * ) Notice: Subject to any disclaimer, the term of this patent is extended or adjusted under 35 U.S.C. 154(b) by 0 days.

(21) Appl. No.: 09/758,517

(22) Filed: Jan. 11, 2001

(51) Int. Cl.[7] ..... F26B 17/24; B08B 7/00
(52) U.S. Cl. ..... 34/58; 134/33
(58) Field of Search ..... 34/58, 59, 87, 34/90, 104, 184, 187, 189, 312, 328; 134/32, 33, 137, 153

(56) References Cited

U.S. PATENT DOCUMENTS 3,419,429 A * 12/1968 Zadron et al. ..... 134/33
3,989,537 A * 11/1976 Sickmeier ..... 134/1
4,571,850 A * 2/1986 Hunt et al. ..... 34/242
4,724,619 A * 2/1988 Poli et al. ..... 34/58
5,567,246 A * 10/1996 Bowden ..... 134/25.4

* cited by examiner

*Primary Examiner*—Joseph Pelham
*Assistant Examiner*—Thor Campbell
(74) *Attorney, Agent, or Firm*—Gifford, Krass, Groh, Sprinkle, Anderson & Citkowski, P.C.

(57) ABSTRACT

A dryer for industrial parts, such as engine blocks, is disclosed having a receiving frame and a conveyor which sequentially moves the industrial parts into the receiving frame. A lock pin is movably mounted to the frame and movable between a lock position in which the lock pin engages the industrial part and prevents the movement of the industrial part relative to the receiving frame, and a release position in which the lock pin is spaced from the industrial part thus permitting movement of the industrial part relative to the receiving frame. A shaft is rotatably mounted to the housing and secured to the receiving frame while a motor is mechanically coupled to the shaft so that, upon activation of the motor and with the lock pin in its lock position, the motor rotatably drives the frame with the industrial part thus expelling water and debris from the industrial part by centripetal force.

8 Claims, 3 Drawing Sheets

SPIN DRYER FOR INDUSTRIAL PARTS

BACKGROUND OF THE INVENTION

I. Field of the Invention

The present invention relates generally to industrial dryers for industrial parts.

II. Description of Related Art

In the manufacture of many industrial parts, such as engine blocks, manifolds, and the like, the industrial part is subjected to a washing operation after the part is machined. Such washing of the industrial part is oftentimes necessary not only to clean the industrial part of fluids, such as cutting oils, but also to remove chips and other debris from the industrial part.

There have been dryers for previously known industrial parts. Many of these previously known dryers merely comprise a housing through which the industrial parts are conveyed after washing. The interior of the dryer housing is both subjected to heat and airflow in an effort to dry the part.

These previously known industrial dryers, however, all suffer from a number of common disadvantages. One disadvantage is that these dryers have proven less than satisfactory in removing chips and other debris from the industrial part during the washing operation. A still further disadvantage of these previously known dryers is that the dryers are relatively large in size, expensive to manufacture and expensive in operating costs.

SUMMARY OF THE PRESENT INVENTION

The present invention provides a dryer for industrial parts which overcomes all of the above-mentioned disadvantages of the previously known dryers.

In brief, the dryer of the present invention comprises a housing having a shaft rotatably mounted to the housing. A receiving frame is secured to one end of the shaft and this receiving frame is dimensioned to receive one or more industrial parts within the interior of the frame. A conveyor within the housing sequentially moves the industrial parts into the receiving frame.

A lock pin is movably mounted to the receiving frame and is movable between a lock position and a release position. In its lock position, the lock pin engages the industrial part contained within the interior of the frame thus preventing movement of the industrial part relative to the frame. Conversely, in its release position, the lock pin is moved out of engagement from the industrial part so that the industrial part can be moved both into and out from the frame by the conveyor. An actuator is associated with the lock pin to move the lock pin between its lock and release position.

A motor is mechanically connected to the shaft so that, upon activation of the motor, the motor rotatably drives the shaft and thus rotatably drives the frame. Thus, with the industrial part contained within the interior of the frame and the lock pin in its lock position, activation of the motor rotatably drives the frame together with its contained industrial part. I doing so, the washing fluid, typically water, is expelled outwardly from the industrial part by centripetal force.

After the motor has rotatably driven the industrial part for a predetermined period of time, typically 10-180 seconds at 50-1500 rpm, the motor is deactivated thus stopping rotation of the frame with its contained industrial part. Thereafter, the lock pin is moved to its release position and the conveyor is actuated to both move the now dried part out of the conveyor frame and, at the same time, move a new undried industrial part into the frame whereupon the above process is repeated.

In some cases, the industrial part will not be completely dried following rotation of the frame. In these cases, the part is moved to a vacuum dryer which removes any residual washing fluid or water from the industrial part.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
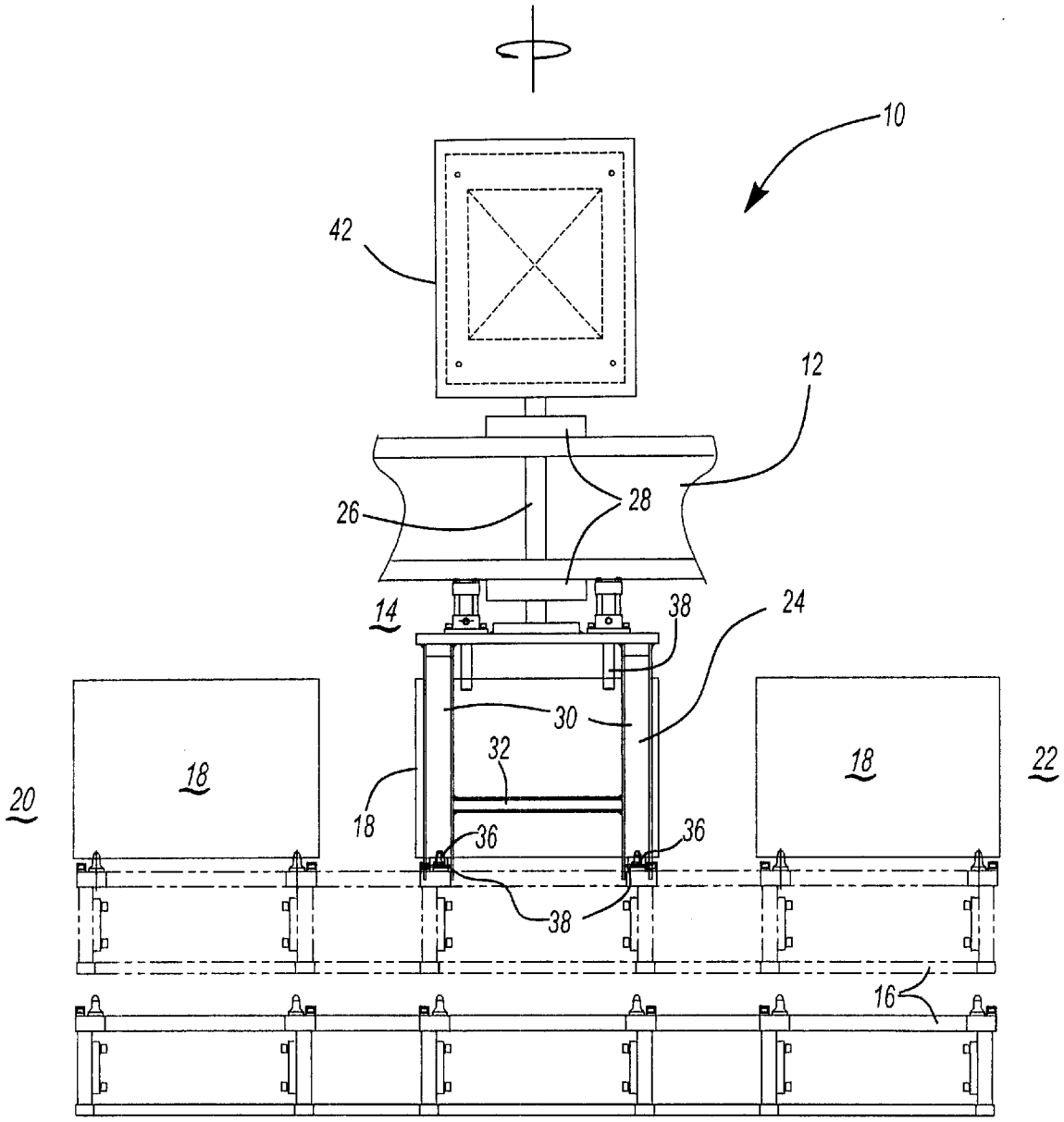
FIG. 1 is a side view illustrating a preferred embodiment of the present invention.

With reference first to FIG. 1, the preferred embodiment of the dryer 10 of the present invention is shown and comprises a housing 12 (only partially illustrated) which defines a drying chamber 14. A conveyor 16, such as a lift and carry conveyor, extends through the housing chamber 14 and sequentially conveys industrial parts 18, such as engine blocks, from an inlet end 20 of the chamber 14 to an outlet end 22 of the chamber 14.

Figure 2:
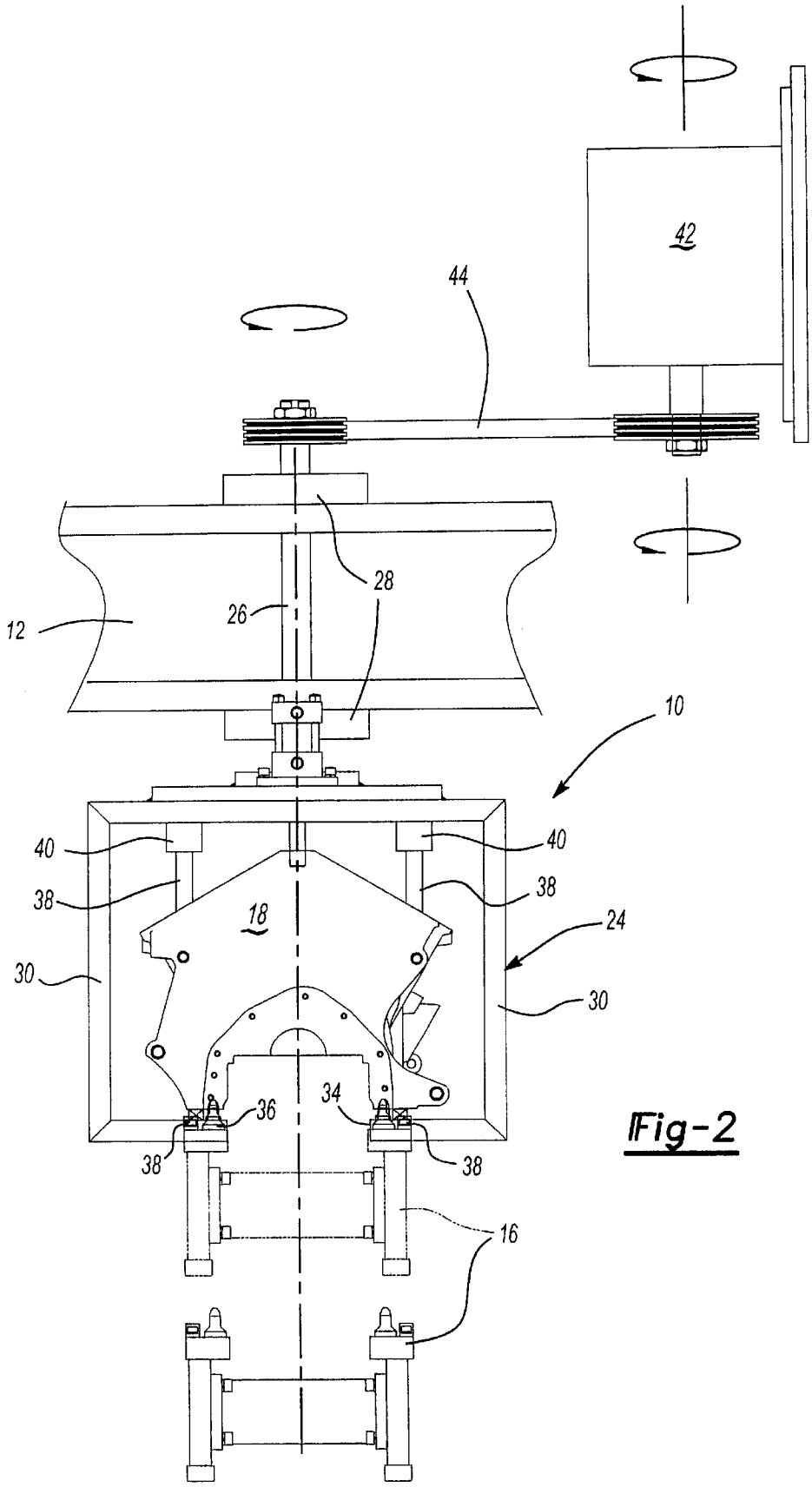
FIG. 2 is an end view taken substantially along line 2-2 in FIG. 1.

Referring now to FIGS. 1 and 2, a receiving frame 24 is rotatably mounted to the housing 12 by a shaft 26. Conventional bearing assemblies 28 are disposed between the housing 12 and shaft 26 to ensure free rotation of both the shaft 26 and its attached receiving frame 24.

The receiving frame 24 generally comprises a pair of spaced apart and generally C-shaped bands 30 which are secured together by one or more cross members 32. As best shown in FIG. 2, the C-shaped bands 30 have a downwardly facing opening 34 aligned with the conveyor 16 so that the conveyor 16, upon actuation, sequentially moves the industrial parts 18 into the interior of the receiving frame 24.

The frame 24 further includes at least one, and more typically two to four location pins 36 at the bottom of the receiving frame 24. These location pins 36 register with location holes in the industrial part 18 when the industrial part 18 is moved into the interior of the receiving frame 24 by the conveyor 16. Consequently, on the down stroke of the conveyor 16, the conveyor 16 lowers the industrial part 18 onto the location pins 36 thus holding the part 18 against lateral movement.

At least one, and preferably two locking pins 38 are mounted to the upper portion of the receiving frame 24. An actuator 40 is associated with each lock pin 38 to move the lock pin 38 between a lock position, in which the lock pin 38 engages the industrial part 18, and a release position, in which the lock pins 38 are spaced from the industrial part 18. Thus, with the lock pins in their locked position (FIG. 2), the part 18 is fixed against movement relative to the receiving frame 24 between the lock pins 38 and location pins 36.

A motor 42, such as an electric motor, is mechanically connected to the shaft 28 by any conventional means, such as a transmission belt 44. Thus, upon activation of the motor 42, the motor 42 rotatably drives the shaft 26 with its attached frame 24.

Figure 3:
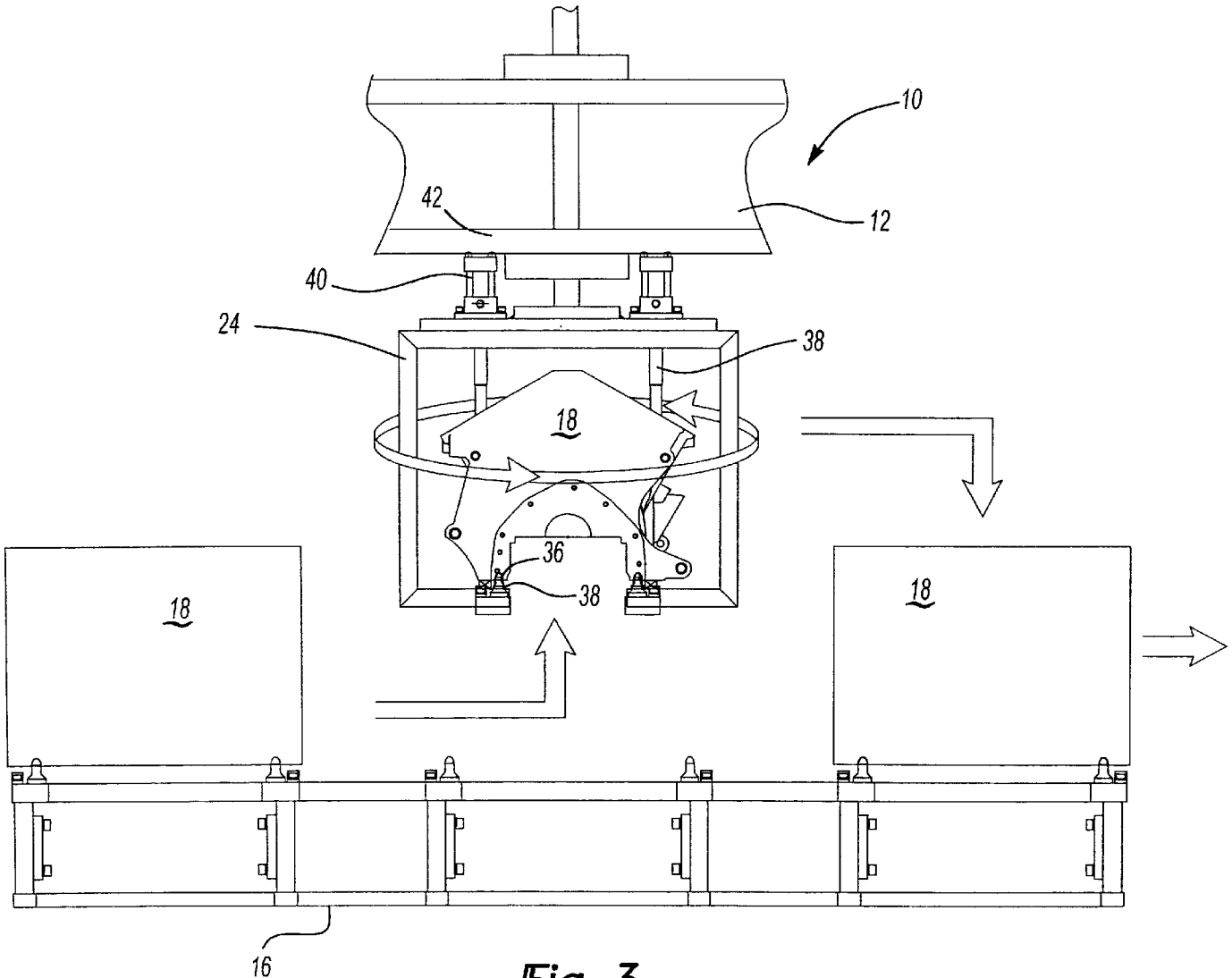
FIG. 3 is a diagrammatic view illustrating the operation of the preferred embodiment of the present invention.

With reference to FIG. 3, in operation, the conveyor 16 first vertically lifts the parts 18 so that the undried part 18 is aligned with the frame 24. The conveyor 16 then longitudinally moves the now dried part 18 from the interior of the receiving frame 24 and simultaneously longitudinally moves a new undried part 18 into the interior of the receiving frame 24. The conveyor 16 then lowers the part 18 on the location pins 36 and, after doing so, the conveyor 16 moves to its lower position, illustrated in solid line in FIGS. 1 and 2, and thus is downwardly spaced from the receiving frame 24.

After the conveyor 16 has positioned the part on the location pins 36, the actuators 40 are actuated thus moving the lock pins 38 to their locked position and fixing the part 18 against movement relative to the receiving frame 24. The motor 42 is then actuated, preferably for 10–180 seconds at 50–1500 rpm, thus rotatably driving the receiving frame 24 with its contained industrial part 18. In doing so, water, washing fluid, debris and the like are expelled outwardly from the part 18 by centripetal force caused by the rotation of the part 18 within the rotating frame 24.

Following rotation of the frame 24, the motor 42 is deactivated thus halting the rotation of the frame 24. The actuators 40 then move the lock pins 38 to their release position so that, upon a subsequent actuation of the conveyor 16, the conveyor 16 removes the now dried part from the receiving frame 18 and simultaneously moves a new washed part 18 into the receiving frame 24 whereupon the above process is repeated.

It can therefore be seen that the present invention provides a simple and yet highly effective system for drying industrial parts. In the event that some dampness remains on the parts, the industrial parts may be completely subsequently dried by subjecting the parts to a vacuum dryer.

Having described my invention, however, many modifications thereto will become apparent to those skilled in the art to which it pertains without deviation from the spirit of the invention as defined by the scope of the appended claims.

I claim:

1. A dryer for industrial parts comprising:

a housing, a receiving frame, a conveyor which sequentially moves the industrial parts through the housing and into the receiving frame, a lock pin movably mounted to said receiving frame and movable between a lock position in which said lock pin engages the industrial part and prevents movement of the industrial part relative to said receiving frame, and a release position in which said lock pin is spaced from the industrial part thus permitting movement of the industrial part relative to the receiving frame, an actuator which selectively moves said lock pin between said lock and said release position, a shaft rotatably mounted to the housing and secured to said receiving frame, and a motor mechanically coupled to the shaft so that, upon activation of said motor, said motor rotatably drives said receiving frame.

2. The invention as defined in claim 1 wherein said conveyor is a lift and carry conveyor.

3. The invention as defined in claim 1 wherein said motor comprises an electric motor.

4. The invention as defined in claim 1 and further comprising at least one locating pin secured to said frame, said locating pin engaging a recess in the industrial part.

5. The invention as defined in claim 1 wherein the industrial part comprises an engine block.

6. The invention as defamed in claim 1 wherein said motor, upon activation, rotatably drives said receiving frame at a speed of 50–1500 rpm.

7. The invention as defined in claim 1 wherein said motor is activated for a period in the range of 10–180 seconds per industrial part.

8. The invention as defined in claim 1 wherein said receiving frame comprises two spaced apart C-shaped bands.

* * * * *